US007749030B1

(12) United States Patent
Smith

(10) Patent No.: US 7,749,030 B1
(45) Date of Patent: Jul. 6, 2010

(54) BATTERY TERMINAL-CABLE CONNECTOR

(76) Inventor: Michael W. Smith, 10190 Buckhead Rd., Rochester, IL (US) 62563

( * ) Notice: Subject to any disclaimer, the term of this patent is extended or adjusted under 35 U.S.C. 154(b) by 0 days.

(21) Appl. No.: 12/460,651

(22) Filed: Jul. 21, 2009

Related U.S. Application Data

(60) Provisional application No. 61/135,466, filed on Jul. 21, 2008.

(51) Int. Cl.
*H01R 4/50* (2006.01)

(52) U.S. Cl. ..... 439/772; 439/754; 439/765

(58) Field of Classification Search ..... None
See application file for complete search history.

(56) References Cited

U.S. PATENT DOCUMENTS 4,695,118 A * 9/1987 Magdesyan et al. ..... 439/726
5,310,365 A * 5/1994 Hashimoto ..... 439/756
5,597,331 A * 1/1997 Gable et al. ..... 439/754
5,733,152 A * 3/1998 Freitag ..... 439/763
6,517,390 B2 * 2/2003 Kim ..... 439/754
6,524,141 B2 * 2/2003 Endo ..... 439/773
6,551,147 B2 * 4/2003 Wakata et al. ..... 439/754
6,802,747 B1 * 10/2004 Orange ..... 439/773
6,830,490 B2 * 12/2004 Murakami et al. ..... 439/755
7,591,692 B1 * 9/2009 Maxwell et al. ..... 439/758

* cited by examiner

*Primary Examiner*—Michael C Zarroli
(74) *Attorney, Agent, or Firm*—Philip L. Bateman

(57) ABSTRACT

A battery terminal-cable connector provides an electrical connection between a battery terminal and a cable. The connector contains an integral cylindrical sleeve and flanges member, a cable fitting, a bolt, a pin, and a cam lever. The cam lever is movable between a first position that allows the flanges to separate and a second position that urges the flanges to contact.

15 Claims, 3 Drawing Sheets

BATTERY TERMINAL-CABLE CONNECTOR

CROSS-REFERENCE TO RELATED APPLICATION

This application claims the benefit of U.S. Provisional Application Ser. No. 61/135,466, Jul. 21, 2008.

FIELD OF THE INVENTION

This invention relates to electrical connectors. More particularly, this invention relates to connectors for establishing electrical contact between a battery terminal and a cable.

BACKGROUND OF THE INVENTION

Batteries produce electricity by means of chemical reactions. A first chemical reaction occurring at a negative terminal releases electrons and a second chemical reaction occurring at a positive terminal consumes electrons. An electrical current is produced by connecting the terminals. Batteries and their terminals are made in many different physical forms.

Batteries of the lead-acid storage type are commonly used in motor vehicles to provide the power to operate the starter of the engine and to run auxiliary devices when the engine is not running. When the engine is running, an alternator provides the electricity to run the auxiliary devices and simultaneously recharges the battery. Lead-acid storage batteries contain two terminals mounted on the top or side of the battery. Cables are attached to the terminals with removable connectors. The terminals of lead-acid storage batteries are commonly posts or threaded receptacles.

The battery terminal-cable connectors of motor vehicle batteries are removed from the terminals when the battery is replaced or serviced, and when other electrical components are serviced. A conventional connector for a battery having post terminals consists of a cylindrical sleeve having two flanges. A threaded bolt passes through holes in the flanges and is secured with a nut. The connector is attached by slipping the sleeve over the post and tightening the nut. The connector is removed by loosening the nut and pulling the connector off the post. The attachment/removal process is slow and requires the use of a wrench or other tool. If the nut is loosened too much, it can separate from the bolt and is easily lost.

A variety of battery post-cable connectors that do not require the use of tools have been disclosed. For example, Chartrain et al., U.S. Pat. No. 4,555,159, Nov. 26, 1985, disclose a battery post-cable connector comprising a U-shaped clamp, a pivoting member, and a lever. Movement of the lever causes the space between the legs of the U-shaped clamp to decrease. The clamp, pivoting member, and lever are relatively large and intricate parts that are expensive to manufacture and are prone to breakage and malfunction.

Other clamping battery post-cable connectors that do not require tools are disclosed in Peterson, U.S. Pat. No. 2,663,854, Dec. 22, 1953; Magdesyan et al., U.S. Pat. No. 4,695,118, Sep. 22, 1987; Inoue et al., U.S. Pat. No. 5,389,466, Feb. 14, 1995; Sharpe et al., U.S. Pat. No. 5,556,309, Sep. 17, 1996; Iby et al., U.S. Pat. No. 6,203,383, Mar. 20, 2001; Murakami et al., U.S. Pat. No. 6,413,124, Jul. 2, 2002; Orange, U.S. Pat. No. 6,971,925, Dec. 6, 2005; Moore, U.S. Pat. No. 7,077,711, Jul. 18, 2006; and Sproesser, U.S. Pat. No. 7,303,448, Dec. 4, 2007. All these connectors either contain intricate parts or are bulky or are expensive to manufacture.

Accordingly, a demand exists for an improved battery terminal-cable connector that can be easily and quickly attached and removed without the use of tools and that is durable, compact in size, inexpensive, composed of few parts, and not prone to the loss of parts.

SUMMARY OF THE INVENTION

The object of this invention is to provide an improved battery terminal-cable connector.

I have invented an improved battery terminal-cable connector. The connector comprises: (a) an integral cylindrical sleeve and parallel opposed flanges; the sleeve being adapted for placement onto a battery post and having a longitudinal axis, a diameter, and a longitudinal split to enable the diameter of the sleeve to vary; the flanges extending outwardly along the split and having aligned holes; (b) a cable fitting having a first end with a receptacle for receiving a cable and a second end with a hole; (c) a bolt passing through the hole in the cable fitting and the hole in the flange, the bolt having a head and a transverse hole oriented parallel to the longitudinal axis of the sleeve; (d) a pin passing through the transverse hole in the bolt and freely rotating within the hole; and (e) a cam lever attached eccentrically to the end of the bolt by the pin, the cam lever having a cutaway portion to provide clearance around the bolt, the cam lever being movable between a first position that allows the flanges to separate and increase the sleeve diameter and a second position that urges the flanges to contact and decrease the sleeve diameter.

The battery terminal-cable connector of this invention is easily and quickly attached and removed without the use of tools. The connector is durable, compact in size, and inexpensive. The connector is composed of few parts and the parts are not prone to loss.

DETAILED DESCRIPTION OF THE INVENTION

Figure 1:
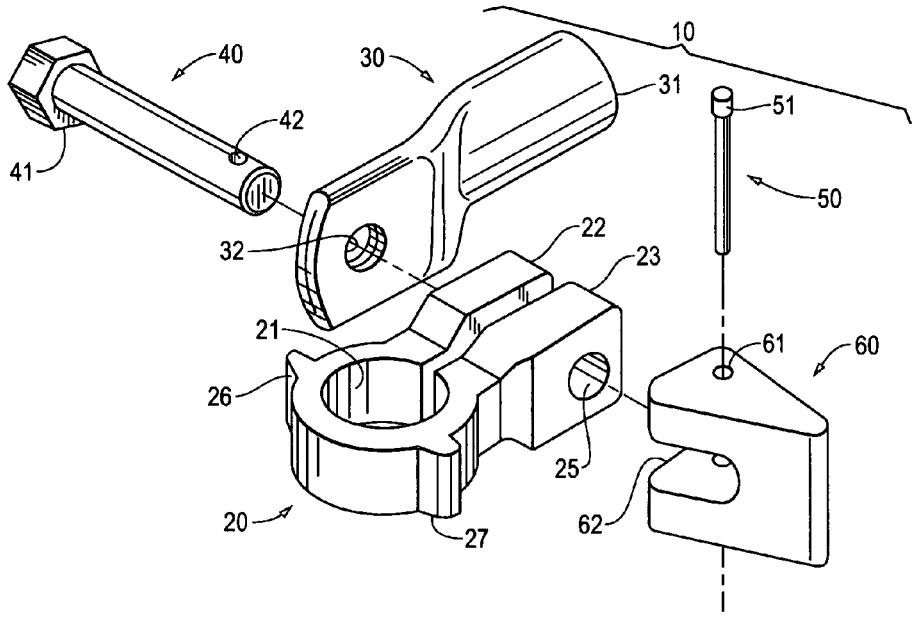
FIG. 1 is an exploded perspective view of a first embodiment of the battery terminal-cable connector of this invention.

This invention is best understood by reference to the drawings. Referring to FIG. 1, a first embodiment of the battery terminal-cable connector 10 is adapted for mounting upon a battery terminal of the post type. The connector comprises an integral sleeve and flanges member 20, a cable fitting 30, a bolt 40, a pin 50, and a cam lever 60. The connector has two positions—a loose position that enables it to be placed upon or removed from a battery post and a tight position in which secure physical (and electrical) contact is made between the connector and the battery post. Each of the components of the battery terminal-cable connector is discussed in detail below.

The integral cylindrical sleeve and flanges member 20 is the portion of the connector that makes physical and electrical contact with the battery terminal. The sleeve of the first embodiment is especially adapted for connection to a battery terminal of the post type. The sleeve has a cylindrical opening 21 with a longitudinal axis and a diameter. The sleeve has a longitudinal split that enables the diameter of the cylindrical opening to vary slightly. The diameter is slightly greater than the diameter of the battery post in the loose position and is equal to the diameter in the tight position.

Two opposed, parallel flanges 22 and 23 extend outwardly along the split. The flanges contain aligned central holes 24 and 25. The sleeve preferably contains two opposed, longitudinal boss projections 26 and 27 on the outer portion of the sleeve. The purpose of the projections, as discussed in more detail below, is to shield the cam lever from accidental movement.

The integral sleeve and flanges member is made of an electrically conductive material that is preferably durable, malleable, and resistant to corrosion. Suitable materials include lead, copper, brass, stainless steel, and the like. The sleeve and flanges member is preferably made of a lead alloy and is most preferably made of a lead alloy containing about four weight percent tin.

The cable fitting 30 connects an electrically conductive cable (not shown) to the sleeve and flanges. The cable fitting has a first end with a receptacle 31 for receiving a cable. In the first embodiment, the receptacle comprises an opening in a cylindrical tube into which the cable is inserted. The cable is secured in the opening by crimping, soldering, clamping, use of a fastener, or other means. The second end of the cable fitting has a hole 32 that facilitates attachment to the sleeve-flange. The cable fitting is made of a durable, electrically conductive material such as copper, brass, stainless steel, and the like. It is preferably made of tin-plated copper. If desired, the cable fitting can be incorporated into the sleeve-flanges member to form an integral unit.

The bolt 40 passes through the hole in the cable fitting and through the holes in the flanges. The bolt contains a hex head 41 and a transverse hole 42 and is preferably unthreaded. In the first embodiment, the transverse hole is at the opposite end of the head. When the battery terminal-cable connector is assembled, the transverse hole is oriented parallel to the longitudinal axis of the sleeve. The bolt is made of one or more parts. An integral bolt is the simplest and least expensive, but it lacks a means for varying the distance between the head and the transverse hole. If desired, a two-part bolt can be used, one part containing internal threads and the other part containing mating external threads. The distance between the head and the transverse hole can then be varied by rotating the two parts relative to each other. Two-part bolts are shown in alternate embodiments illustrated in FIGS. 7, 8, and 9. Although not shown, a standard metal washer is preferably inserted onto the bolt so that it is positioned between the head and the cable fitting when the connector is assembled.

The pin 50 passes through the cam lever and the transverse hole in the bolt. Although the pin is secured in position by frictional fit, it is preferable that the pin contain a head 51 at one end to facilitate disassembly if required.

The cam lever 60 is attached eccentrically to the end of the bolt by the pin. The eccentric attachment results from the hole 61 through the cam lever being at an offset location, i.e., a location that is closer to one edge than the other edge. The cam lever contains a cutaway portion 62 that provides clearance around the bolt. The cutaway portion creates two lobes, the hole passing completely through each. The cam lever is preferably of the type commonly known as a D-wing lever. When viewed from above, the D-wing lever has the shape of the Greek letter delta (which provides the basis for its name). More particularly, the D-wing lever has the shape of an isosceles triangle (with two equal-length sides that are longer than the third side) with three slightly rounded edges. The cam lever is made of a conductive or a non-conductive material. The cam lever is preferably made of a non-conductive hard plastic material and is most preferably made of nylon.

The battery terminal-cable connector is assembled by inserting the bolt through the washer (if one is used), the cable fitting, and the flanges. The cam lever is then positioned over the projecting end of the bolt. The pin is then inserted through the hole in the first lobe of the cam lever, through the transverse hole in the bolt, and through the hole in the second lobe of the cam lever.

Figure 2:
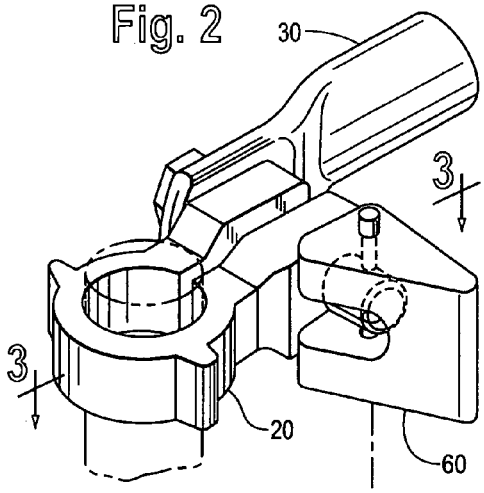
FIG. 2 is an assembled perspective view thereof showing the connector in the loose position.
Figure 4:
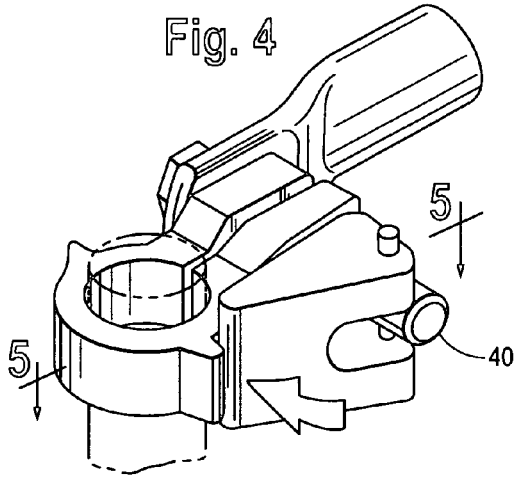
FIG. 4 is an assembled perspective view thereof showing the connector in the tight position.
Figure 3:
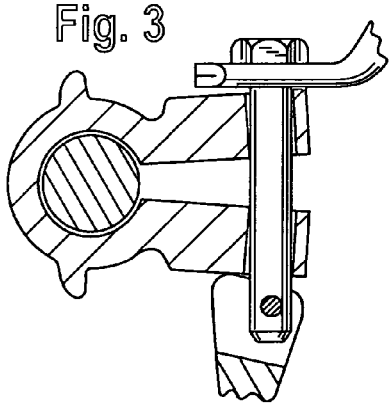
FIG. 3 is a partial section taken along line 3-3 of FIG. 2.
Figure 5:
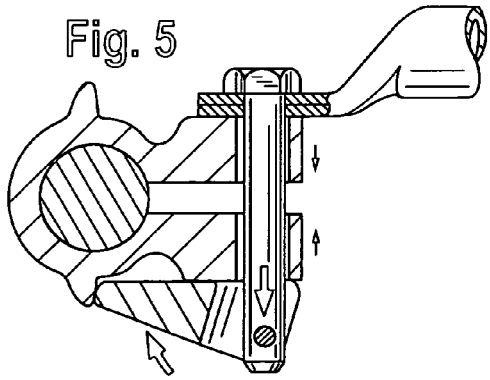
FIG. 5 is a partial section taken along line 5-5 of FIG. 4.

As previously mentioned, the battery terminal-cable connector has two positions—a loose position that enables it to be placed upon or removed from a battery post and a tight position in which secure physical (and electrical) contact is made between the connector and the battery post. The loose position is shown in FIGS. 2 and 3. The tight position is shown in FIGS. 4 and 5. The battery post is shown in phantom lines in FIGS. 2 and 4. It can be seen that moving the cam lever from the loose position to the tight position causes the flanges to move closer to each other which, in turn, causes the diameter of the sleeve to decrease. The flanges are preferably biased toward the loose position. In other words, the flanges move apart (return to the loose position) automatically when the cam lever is released.

When the cam lever is in the tight position shown in FIGS. 4 and 5, the pointed tip of the lever is tucked behind one of the boss projections of the sleeve. This location reduces the chances of the lever being accidentally hit or dislodged.

It can be appreciated that the battery terminal-cable connector of this invention is easily and quickly attached and removed without the use of tools. The connector of this invention is as durable and as compact in size as conventional connectors having a threaded bolt and nut for tightening the sleeve. The connector of this invention is less expensive to manufacture than conventional connectors. The components of the first embodiment of the connector remain together once assembled so the danger of losing parts is eliminated.

Figure 6:
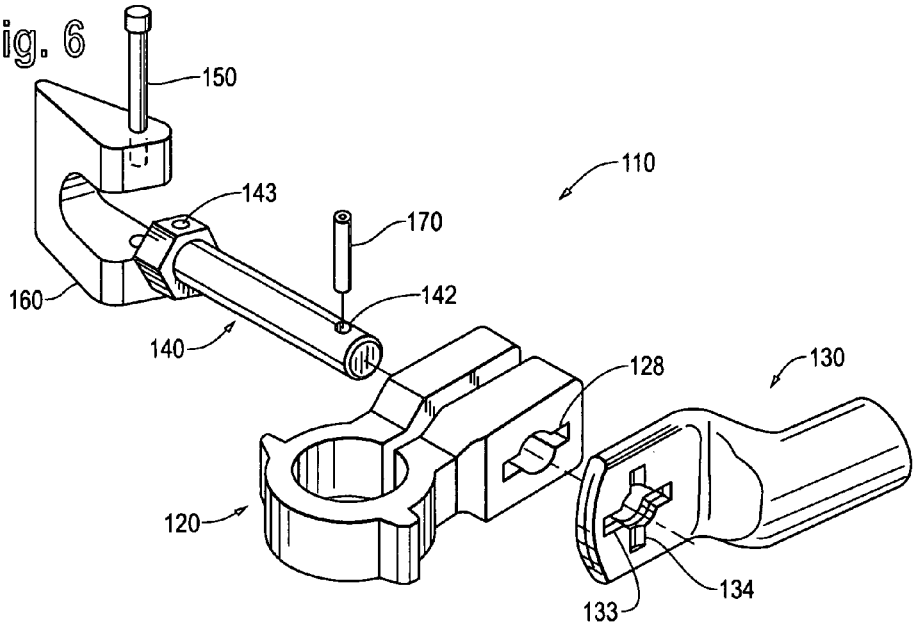
FIG. 6 is an exploded perspective view of a second embodiment of the battery terminal-cable connector of this invention.

Referring now to FIG. 6, a second embodiment of the battery terminal-cable connector 110 differs from the first embodiment in several minor respects. A first difference is that the head of the bolt 140 and the cam lever 160 are on the same side of the sleeve-flanges member 120. A second difference is that the bolt contains a hole 143 in its head for the pin 150. A third difference is that the hole 142 in the end of the bolt opposite the head is used to hold an anchor pin 170 that retains the bolt in position. To accommodate the anchor pin, the holes 124 and 125 in the flanges of the sleeve contain channels 128. The cable fitting contains two corresponding channels 133 that extend through the entire depth of the cable fitting. The cable fitting contains two recessed indentations 134 that are rotated from the wings by 90 degrees. After the bolt is inserted through the flanges and cable fitting, it is rotated 90 degrees to align the anchor pin with the indentations and to lock it into position.

Figure 7:
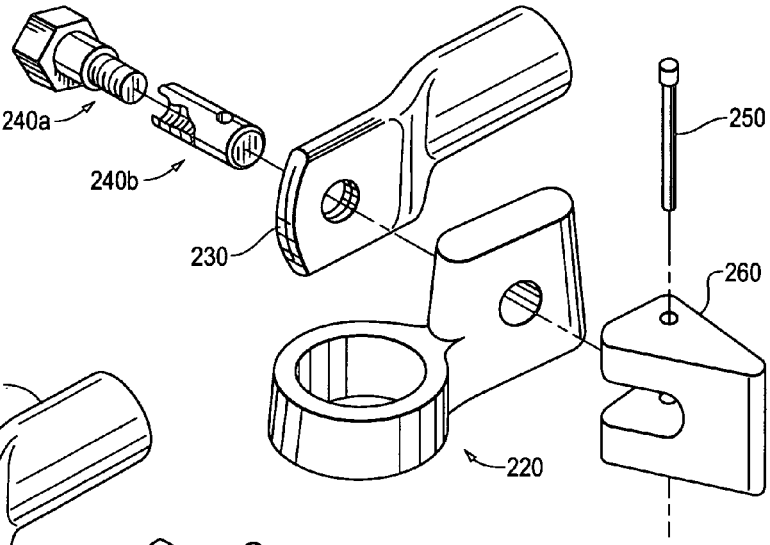
FIG. 7 is an exploded perspective view of a third embodiment of the battery terminal-cable connector of this invention.

Referring now to FIG. 7, a third embodiment of the battery terminal-cable connector 210 differs from the first two in two major respects. First, the integral sleeve and flange member 220 forms a complete ring so that it has a fixed diameter. Second, the integral sleeve and flange member contains only one radially oriented flange (rather than two radially oriented flanges). This type of sleeve, commonly known as a flag type, is attached permanently to battery terminals of the type used for solar and wind turbine applications. The contact between the sleeve-flange 220 and cable fitting 230, not between the sleeve-flange and the terminal, determines electrical conductivity. Movement of the cam lever 260 tightens and loosens the cable fitting against the flange. The cable fitting of the third embodiment cannot be completely separated from the sleeve without disassembling the connector by removing the pin 250 and then withdrawing the bolt 240. As previously mentioned, the third embodiment contains a bolt that is made of two parts 240*a* and 240*b*. Threading the two parts relative to each other enables the distance between the head of the bolt and the transverse hole to be adjusted.

Figure 8:
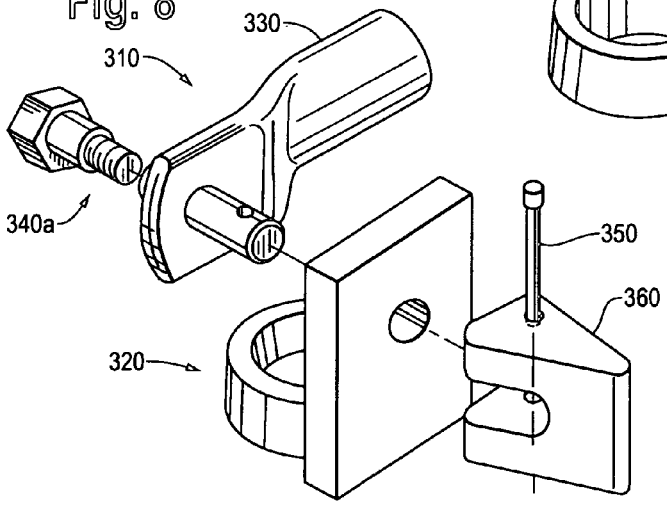
FIG. 8 is an exploded perspective view of a fourth embodiment of the battery terminal-cable connector of this invention.

Referring now to FIG. 8, a fourth embodiment of the battery terminal-cable connector 310 is similar to the third embodiment except the integral sleeve and flange 320 contains a flange that is oriented tangentially to the sleeve (rather than being oriented radially as in the third embodiment). This type of sleeve, commonly known as an L-type, is attached permanently to battery terminals of the type used for solar and wind turbine applications.

Figure 9:
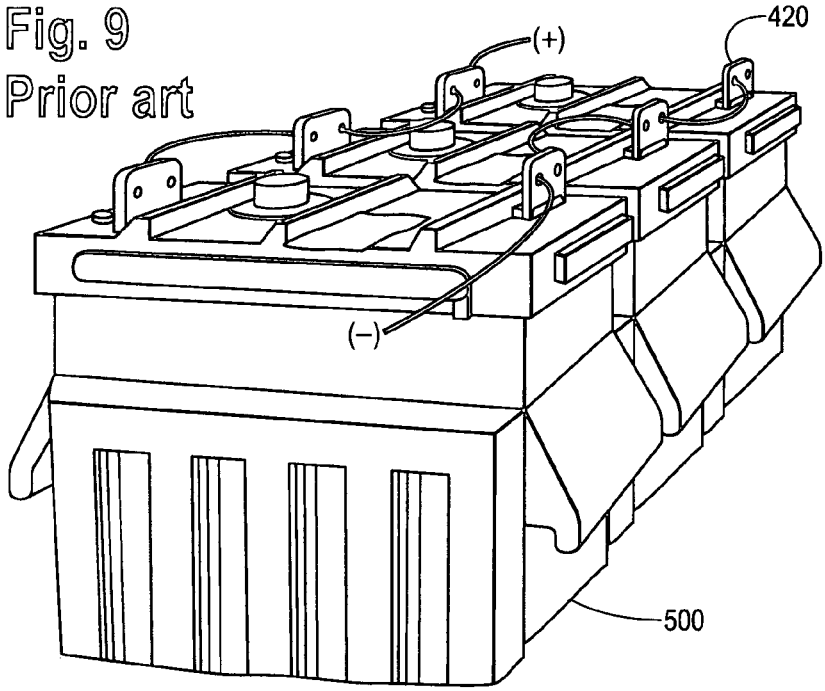
Fig. 9 Prior art
FIG. 9 is a perspective view of three prior art batteries connected together.
Figure 10:
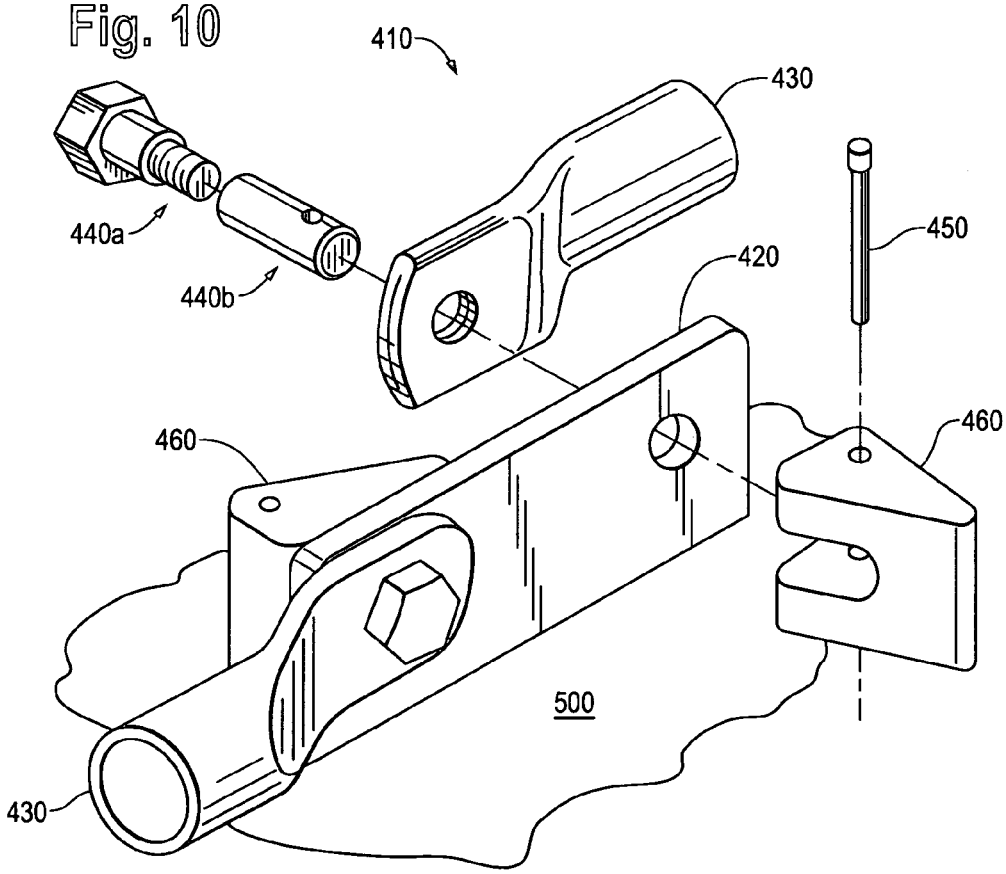
FIG. 10 is an exploded perspective view of a fifth embodiment of the battery terminal-cable connector of this invention.

Referring now to FIG. 9, some prior art batteries 500 contain terminals 420 that are in the shape of flanges rather than posts. In this type of battery, the sleeve is inside the battery case so there is no separate terminal structure, other than the flange, on the exterior of the battery. This type of battery is often connected electrically with other similar batteries. FIG. 9 illustrates three such batteries connected together. Referring now to FIG. 10, a fifth embodiment of the battery terminal-cable connector 410 is especially adapted for use with this type of battery. The fifth embodiment is similar to the fourth embodiment except the flange 420 forms the terminal of the battery. The flange of the fourth embodiment also differs from the flange of the third embodiment in that it contains two holes.

I claim:

1. A battery terminal-cable connector comprising:

(a) an electrically conductive integral sleeve and flanges member; the sleeve being adapted for placement onto a battery post terminal and having a cylindrical shape, a longitudinal axis, a diameter, and a longitudinal split to enable the diameter of the sleeve to vary; the flanges being opposed and parallel, extending outwardly along the split, and having aligned holes;

(b) an electrically conductive cable fitting having a first end with a receptacle for receiving a cable and a second end with a hole;

(c) a bolt passing through the hole in the cable fitting and the holes in the flanges, the bolt having a head and an end with a transverse hole oriented parallel to the longitudinal axis of the sleeve;

(d) a pin passing through the transverse hole in the bolt; and (e) a cam lever attached eccentrically to the end of the bolt by the pin, the cam lever having a cutaway portion to provide clearance around the bolt, the cam lever being movable between a first position that allows the flanges to separate and increase the sleeve diameter and a second position that urges the flanges to contact and decrease the sleeve diameter.

2. The battery terminal-cable connector of claim 1 wherein the sleeve contains an outer surface having a longitudinal boss projection spaced apart from the cam lever such that the cam lever is shielded from accidental movement in the second position.

3. The battery terminal-cable connector of claim 2 wherein the cam lever comprises a D-wing lever.

4. The battery terminal-cable connector of claim 3 wherein the bolt has two ends with the head at a first end and the transverse hole at a second end.

5. The battery terminal-cable connector of claim 3 wherein the bolt has two ends with the head and transverse hole at a first end.

6. A battery terminal-cable connector comprising:

(a) an electrically conductive integral sleeve and flange member, the sleeve being adapted for placement onto a battery terminal and having a cylindrical shape with a longitudinal axis, and the flange having a hole;

(b) an electrically conductive cable fitting having a first end with a receptacle for receiving a cable and a second end with a hole;

(c) a bolt passing through the hole in the cable fitting and the hole in the flange, the bolt having a head and a transverse hole oriented parallel to the longitudinal axis of the sleeve;

(d) a pin passing through the transverse hole in the bolt and freely rotating within the hole; and (e) a cam lever attached eccentrically to the end of the bolt by the pin, the cam lever having a cutaway portion to provide clearance around the bolt, the cam lever being movable between a first position that tightens the cable fitting against the flange and a second position that loosens the cable fitting against the flange.

7. The battery terminal-cable connector of claim 6 wherein the cam lever comprises a D-wing lever.

8. The battery terminal-cable connector of claim 7 wherein the sleeve contains an outer surface having a longitudinal boss projection spaced apart from the cam lever such that the cam lever is shielded from accidental movement in the second position.

9. The battery terminal-cable connector of claim 8 wherein the D-wing lever is made of plastic.

10. The battery terminal-cable connector of claim 9 wherein the bolt comprises two mating pieces to provide a means for varying the position of the transverse hole relative to the head.

11. A battery terminal-cable connector comprising:

(a) an electrically conductive flange having a hole;

(b) an electrically conductive cable fitting having a first end with a receptacle for receiving a cable and a second end with a hole;

(c) a bolt with two ends passing through the hole in the cable fitting and the hole in the flange, the bolt having a head and a transverse hole;

(d) a pin passing through the transverse hole in the bolt; and (e) a cam lever attached eccentrically to the end of the bolt by the pin, the cam lever having a cutaway portion to provide clearance around the bolt, the cam lever being movable between a first position that allows the cable fitting to separate from the flange and a second position that urges the cable fitting and the flange together.

12. The battery terminal-cable connector of claim 11 wherein the flange is integral with a sleeve.

13. The battery terminal-cable connector of claim 12 wherein the cam lever comprises a D-wing lever.

14. The battery terminal-cable connector of claim 13 wherein the sleeve is fully enclosed.

15. The battery terminal-cable connector of claim 13 wherein the sleeve is split.

* * * * *